US007742611B2

(12) United States Patent
Grafenberg et al.

(10) Patent No.: US 7,742,611 B2
(45) Date of Patent: Jun. 22, 2010

(54) HEARING AID

(75) Inventors: Esfandiar Grafenberg, Effeltrich (DE); Volkmar Hamacher, Neunkirchen am Brand (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1132 days.

(21) Appl. No.: 11/385,049

(22) Filed: Mar. 17, 2006

(65) Prior Publication Data

US 2006/0215861 A1 Sep. 28, 2006

(30) Foreign Application Priority Data

Mar. 21, 2005 (DE) ..... 10 2005 012 983

(51) Int. Cl.
*H04R 25/00* (2006.01)

(52) U.S. Cl. ..... 381/312; 381/60

(58) Field of Classification Search ..... 381/60, 381/312

See application file for complete search history.

(56) References Cited

U.S. PATENT DOCUMENTS 4,820,059 A * 4/1989 Miller et al. ..... 704/254
7,206,416 B2 * 4/2007 Krause et al. ..... 381/60
2005/0027537 A1 2/2005 Krause et al.

FOREIGN PATENT DOCUMENTS

DE 103 93 463 T5 9/2005
WO WO 2004/034739 A1 4/2004

OTHER PUBLICATIONS

T. Tarnóczy and G. Fant, Some remarks on the average speech spectrum, Q.P.S.R. Report No. 4, Jan. 1, 1964.
Elizabeth W. W. Chua, Speech recognition predictability of a Cantonese speech intelligibility index, May 2004, Hong Kong University, URL:http://sunzi.lib.hku.hk/hkuto/record/B30509737.
Wong et al, Development of the Cantonese speech intelligibility index, Acoustical Society of Amerika. Journal, Acoustical Society of Amerika, Melville, NY, US, Bd. 121, Hr. 6, May 16, 2007.
Amy H.S. Ho, A preliminary study of the frequency importance function of Cantonese sentences, 2002 Hong Kong University URL:http://sunzi.lib.hku.hk/hkuto/record/B29150814.
Amy Stafford; "An Introduction to Tonal Languages"; [Retrieved from] http://www.mnsu.edu/emuseum/cultural/language/tonal.html; [Retrieved on] Mar. 14, 2006; pp. 1-5.
Peter Avery and Susan Erlich, "Teaching American English Pronunciation"; 1992; p. 77; Oxford University; Oxford, United Kingdom.
J.C. Catford; "A Practical Introduction to Phonetics"; 1988; p. 183; Clarendon Press; Oxford, United Kingdom.

* cited by examiner

*Primary Examiner*—Brian Ensey

(57) ABSTRACT

A hearing device is to be developed for hearing device wearers who speak different national languages. For this purpose, pro-vision is made to equip a hearing device with a storage facility for storing first data which is characteristic of a first language and a processing facility for processing an input signal. At least second data, which is characteristic of a second language, can be stored in the storage facility. The input signal can thus alternatively be processed as a function of the first or the second data. By way of example, the interference noise suppression or the microphone configuration can hereby be adjusted in a language-dependent manner.

10 Claims, 1 Drawing Sheet

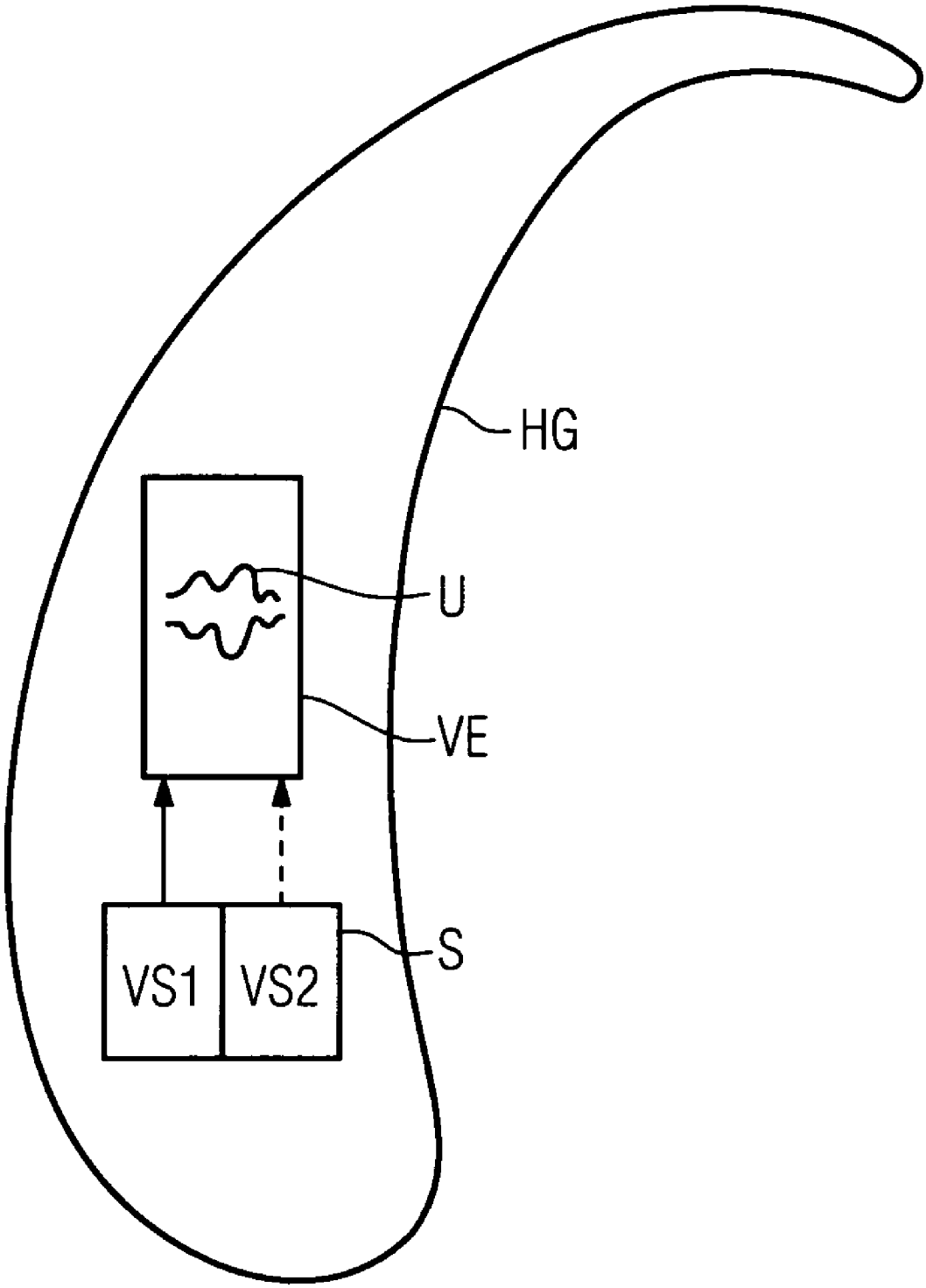
HG
U
VE
S
VS1
VS2

HEARING AID

CROSS REFERENCE TO RELATED APPLICATIONS

This application claims priority to the German Application No. 10 2005 012 983.8, filed Mar. 21, 2005 which is incorporated by reference herein in its entirety.

FIELD OF INVENTION

The present invention relates to a hearing device with a storage facility for storing data which is characteristic of a first language and a processing facility for processing an input signal. Furthermore, the present invention relates to a method for operating a hearing device.

BACKGROUND OF INVENTION

The amplification during the signal processing in the hearing device is usually chosen at varying degrees in the individual frequency bands of the hearing spectrum. A number of reasons exist for this. Language comprehensibility should hereby be assisted amongst other things.

SUMMARY OF INVENTION

Modern hearing devices are also frequently equipped with automatic mechanisms, which reliably ensure that different hearing situations are recognized. By way of example, the hearing situation "speaking" should thus be able to be automatically distinguished from the hearing situation "music", so that in a corresponding hearing program, a special microphone configuration or a specific interference noise suppression mechanism can be switched on without the hearing device wearer having to intervene.

The operation of the hearing device thus depends in many cases on the language of the hearing device wearer. As a result of the plurality of possible languages, the hearing device should also be operated in a language-specific manner. The reason for this is that tonal languages, such as Chinese for instance, are structured differently from European languages.

The signal processing of the hearing devices is optimized in many cases for European languages. By way of example, the recognition of the hearing situation "speaking in ambient noise", is worth noting, with which the language must be immediately taken into account. This language-dependent optimization results in a suboptimal utilization of the signal processing which is disadvantageous for the East Asian hearing device wearer due to effects, e.g. on the language comprehensibility.

Many South East Asian and African languages are tonal languages. These languages use a pitch increase to signal a difference in meaning between words (cf. Avery, Peter and Susan Ehrlich, Teaching American English Pronunciation, Oxford University Press: Oxford, 1992, page 77). These variations in the pitch form an important part of the language, like the strain and suitable word sequences in other languages. In these languages, the meaning or the grammatical category, such as the tense, depends on the pitch (cf. Catford, J. C., A Practical Introduction to Phonetics, Clarendon Press: Oxford, 1988, page 183). An introduction to tonal languages is given in the article by Amy Stafford.

Publication DE 103 93 463 T5 discloses a hearing aid, which generates a noise-vocoded voice acoustic signal, which thereby achieves that at least one part of the input acoustic signal is divided into a frequency band signal and one of the frequency band signals is multiplied with a noise signal so that a corresponding noise-vocoded voice signal emerges. In this case, the number of band filters for subdividing frequency band signals or the frequency of a frequency band limit can be modified by automatic language recognition.

An object of the present invention is to propose a hearing device, which is suitable for hearing device wearers from different language areas. Furthermore, a corresponding method should be provided, by means of which a hearing device can be operated in a similarly convenient manner for hearing device wearers from different language areas.

This object is achieved by the claims, with a storage facility for storing first data which is characteristic of a first language and a processing facility for processing an input signal, with at least second data which is characteristic of a second language being able to stored in the storage facility and the input signal alternatively being able to be processed as a function of the first or the second data.

Provision is further made for a method for operating a hearing device by automatically determining an item of language information which is characteristic of a language, storing several items of processing information in the hearing device, selecting one of the several items of processing information based on the determined language information and processing a hearing device input signal as a function of the selected processing information.

Here the characteristic data comprises a language-specific amplification pattern with an amplification value in each instance for several frequency bands. It is thus possible to purposefully adjust the amplification of the hearing device in a language-dependent manner.

The hearing device can feature a language recognition facility for automatically recognizing the language of the input signal. The hearing device must thus not be set up specifically for the market in which it is sold.

The recognition of the language or national language as applicable can be carried out on the basis of the tonality of said language. The tonality represents a significant criterion for reliably recognizing specific language types.

The processing facility of the hearing device according to the invention can have a number of hearing programs, into which one can switch depending on the language. Other filters can thus be used for instance to recognize the hearing situation "speaking" with the corresponding choice of the hearing program with a first language than with a second language, so that this hearing situation can be recognized in a more reliable manner.

Other hearing device settings such as an interference noise suppression mechanism, a microphone configuration or the like are also preferably increased on the hearing device assisting different languages by the hearing device wearer.

BRIEF DESCRIPTION OF THE DRAWINGS

The present invention is now described with reference to the appended drawings, which display a schematic diagram for a hearing device according to the invention.

The exemplary embodiments illustrated in more detail below represent preferred embodiments of the present invention.

DETAILED DESCRIPTION OF INVENTION

The hearing device HG displayed in the figure features a processing unit VE. The processing facility, with which the microphone signals of the hearing device can be correspondingly amplified, exhibits a language recognition unit (not shown). These use the envelope U of an acoustic signal for language recognition. The implementation of a typical envelope or other characteristic data of tonal languages, such as Chinese for instance, as a basis for the language recognition, allows the acoustician to optionally adapt specific adjustments of the device, e.g. the amplification, to the language of the hearing aid wearer, whilst the device is being programmed.

In the graphically displayed example the hearing device HG features a storage facility S, in which two amplification sets VS1 and VS2 are stored. Each amplification set contains the amplification values for the frequency bands of the hearing spectrum, since the processing in the hearing device is typically carried out in a frequency band-dependent manner. If a specific language of the receiving signal is now determined on the basis of the envelope U, the corresponding amplification data set VS1, VS2 is loaded from the storage facility S into the processing facility VE and is used there for amplification purposes.

Instead of or in addition to amplification data, other adjustment data, for instance an interference noise suppression mechanism, can be stored for instance in the storage facility S. To reliably distinguish the respective language from an interference noise, it is expedient to match the interference noise suppression mechanism exactly to the used language. Filter data can thus be stored in the storage facility S for instance and read out in a language-dependent manner for the processing facility VE.

Other adjustments of the hearing device, such as the microphone configuration for instance, can be adjusted using the illustrated design of a hearing device HG. An adjustment of the microphone configuration is necessary in order to avoid disadvantages in the language comprehensibility, which arise for instance in that microphones are wrongly switched over from a directional operation into an omnidirectional operation. This could be the case if language signals in tonal languages are recognized as music.

In the exemplary embodiment illustrated above, the hearing device is automatically switched from one language to another language by means of language recognition. With a simplified variant of a hearing device according to the invention, the processing facility VE is adjusted first of all by an acoustician on a software or hardware basis for the relevant language, for example at the push of a button or programming flat. This means that a single hearing device can be manufactured for all markets, in the storage facility S of which the respective language-specific adjustment data is stored and that is preprogrammed for the respective language.

In the example illustrated above, data for two different languages has been stored in the storage facility S. Corresponding adjustment data can naturally also be stored for three, four or more languages in the storage facility, provided the storage facility has sufficient storage space.

It is additionally worth mentioning here, that the hearing device according to the invention can be developed as a behind-the-ear hearing device or also as an in-the-ear hearing device.

The invention claimed is:

1. A hearing aid, comprising:

a memory for storing first and second data characteristics of a first and respectively a second language;

a processing unit for processing an input signal, the processing unit configured to selectively process the input signal based either on the first or on the second data, wherein the first and second characteristic data each comprise a language-specific amplification pattern having a plurality of amplification factors corresponding to a plurality of frequency bands; and a language recognition unit for automatically identifying a language associated with the input signal, wherein the processing unit is configured to amplify the input signal relative to the plurality of frequency bands based on the identified language.

2. The hearing aid according to claim 1, wherein the language recognition unit is configured to identify the language based upon an envelope of a frequency spectrum related to the input signal.

3. The hearing aid according to claim 1, wherein the language recognition unit is configured to identify the language based upon a tonality present in the input signal and associated with the language to be identified.

4. The hearing aid according to claim 1, wherein the processing unit comprises a plurality of selectable hearing programs, each hearing programs related to a specific language.

5. The hearing device according to claim 1, wherein the processing unit comprises a plurality of selectable interference noise suppression mechanisms, each interference noise suppression mechanism related to a specific language.

6. The hearing aid according to claim 1, wherein the processing unit comprises a plurality of selectable microphone configurations, each microphone configuration related to a specific language.

7. A method of adjusting a hearing aid, comprising:

determining from an input signal an item of language information characteristic of a language associated with the input signal;

determining the language associated with the input signal based upon the item of language information;

storing a plurality of processing information items in the hearing aid;

selecting one of the plurality of processing information items based upon the determined language; and processing the input signal based upon the selected processing information item, wherein the input signal is amplified relative to a plurality of frequency bands, each frequency band related to a corresponding amplification factor, the frequency bands selected based on the identified language.

8. The method according to claim 7, wherein the language is determined based upon an envelope of a frequency spectrum related to the input signal.

9. The method according to claim 7, wherein the input signal is processed by an element selected from the group consisting of a hearing aid program adapted to the identified language; an interference noise suppression mechanism adapted to the identified language and a microphone configuration adapted to the identified language.

10. The method according to claim 7, wherein the hearing aid comprises a plurality of hearing aid programs, interference noise suppression mechanisms or microphone configurations corresponding to a plurality of languages.

* * * * *